US006591716B2

(12) United States Patent
Wantz

(10) Patent No.: US 6,591,716 B2
(45) Date of Patent: Jul. 15, 2003

(54) UNIVERSAL TOOL FOR DETACHING AND RETRIEVING OVERHEAD MOUNTED SMOKE AND HEAT DETECTORS

(75) Inventor: James C. Wantz, Mesa, AZ (US)

(73) Assignee: Home Safeguard Industries, L.L.C., Vernon Hills, IL (US)

( * ) Notice: Subject to any disclaimer, the term of this patent is extended or adjusted under 35 U.S.C. 154(b) by 0 days.

(21) Appl. No.: 09/924,241

(22) Filed: Aug. 7, 2001

(65) Prior Publication Data

US 2003/0029279 A1 Feb. 13, 2003

(51) Int. Cl.[7] ..... B25B 23/00; B25B 13/56

(52) U.S. Cl. ..... 81/53.1; 81/176.15; 294/19.1

(58) Field of Search ..... 81/53.1, 53.11, 81/53.12, 461, 176.1, 176.15, 176.2, 176.3, 3.4, 3.41; 294/19.1, 99.1; 269/900, 305

(56) References Cited

U.S. PATENT DOCUMENTS

| | | | | | |
|---|---|---|---|---|---|
| 1,926,948 | A | * | 9/1933 | Iffland | 81/53.12 |
| 2,681,822 | A | * | 6/1954 | Daniels | 81/53.11 |
| 4,982,629 | A | * | 1/1991 | Germain | 81/176.15 |
| 5,193,420 | A | * | 3/1993 | Smith | 81/185 |
| 5,765,453 | A | * | 6/1998 | Mims | 81/53.11 |
| 5,845,552 | A | * | 12/1998 | Piascik | 81/176.15 |

* cited by examiner

*Primary Examiner*—D. S. Meislin
(74) *Attorney, Agent, or Firm*—Natan Epstein

(57) ABSTRACT

A tool for removing overhead mounted smoke and heat detectors by an operator standing on the ground. The tool has a tool head supported on an extension handle for elevating the tool head into proximity to the detector unit. A number of grip elements on the tool head capture and rotate the removable head of the detector unit. The grip elements can be rearranged on the tool head into various configurations adapted to fit the shapes and sizes of different detector units, thereby providing a universal detector removal tool.

15 Claims, 4 Drawing Sheets

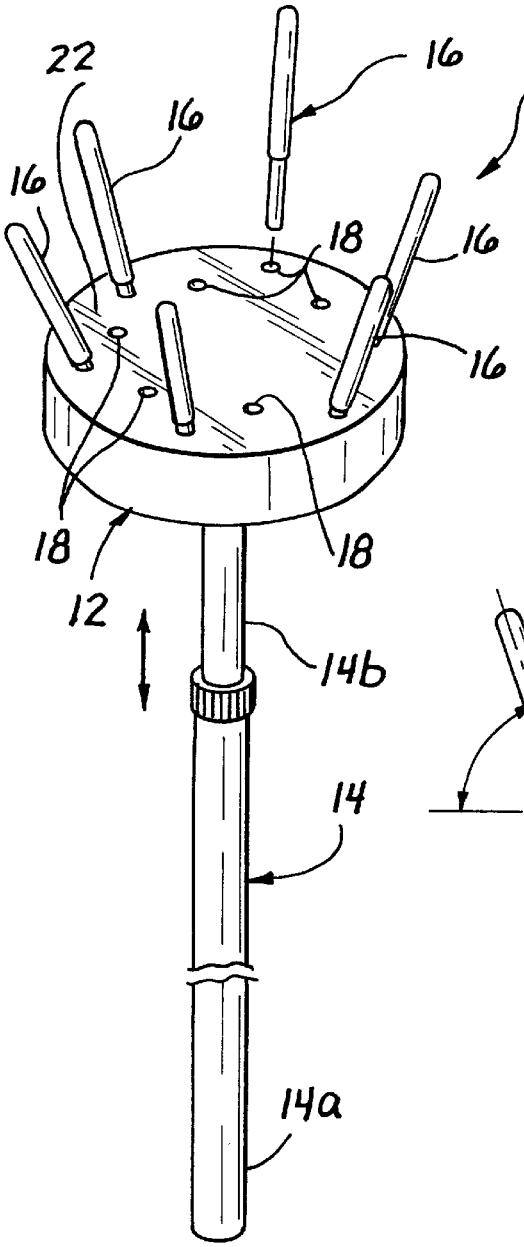
Fig. 1
Fig. 2
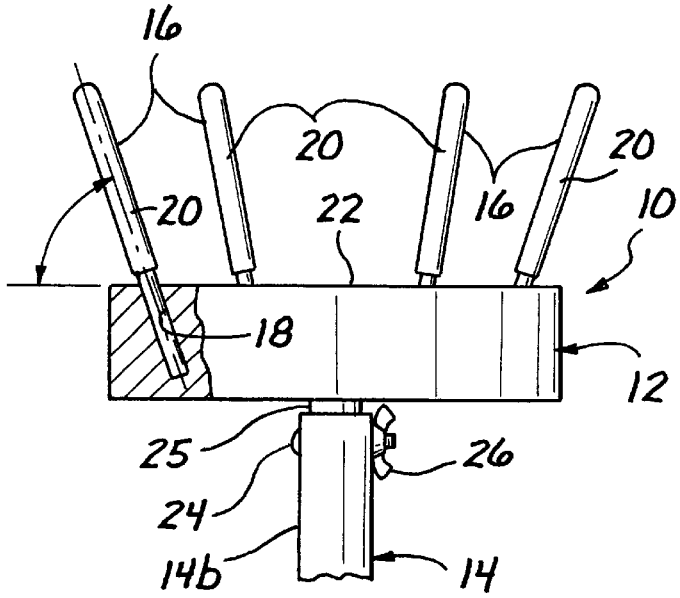
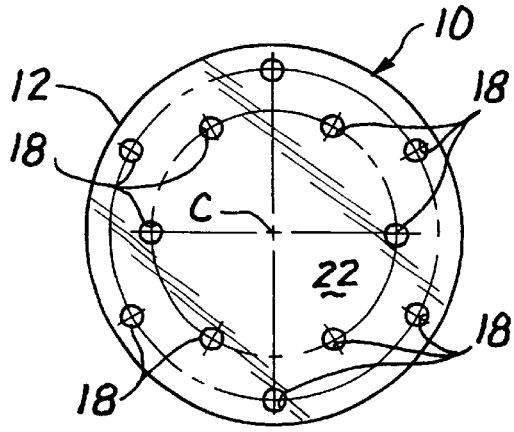
Fig. 3

UNIVERSAL TOOL FOR DETACHING AND RETRIEVING OVERHEAD MOUNTED SMOKE AND HEAT DETECTORS

BACKGROUND OF THE INVENTION

1. Field of the Invention

This invention relates to a hand tool for facilitating detachment and retrieval of overhead mounted electronic detectors such as smoke and heat detectors for testing and maintenance purposes.

2. State of the Prior Art

Electronic heat and smoke detectors are in wide use, with millions of installed units presently in service in commercial, industrial and public buildings. Maintenance of these electronic detector units calls for periodic testing to verify that the detector sensitivity is within manufacturer's specification. This is done on the premises by means of a test instrument designed for this purpose which checks the sensitivity of the detector and if necessary assists in returning the detector to the proper operational parameters. Also, the detector housing normally has a number of small openings intended to admit ambient air into proximity to or contact with the electronic sensor of the detector unit. These openings may be relatively small and in time become occluded by accumulation of lint, dust, cobwebs and the like. Proper maintenance of the installed detector units calls for removal and cleaning of the detector head to ensure unobstructed flow of air into the detector housing.

The detector units, however, are normally installed on or near the ceiling of the protected space for earliest detection of rising smoke and heat. In many public and industrial spaces the ceiling may be at a considerable height above the floor, making access to the detector units a challenge.

Each detector unit normally has a detector base which is fastened to a mounting surface such as a ceiling or wall surface, and a detector head which includes an electronic sensing assembly, for example, a smoke or heat sensor and related circuitry along with an audible and sometimes a visual alarm device, contained in a detector head housing. The detector head is typically twist locked to the detector base and can be separated from the base by turning though a short arc of rotation.

Manufacturers of the electronic detector units provide detector removal tools for use by maintenance personnel with an extension handle and a detector grip at one end which allow the user to reach, detach and lower a detector unit mounted high above and well beyond arm's length reach of a maintenance person standing on the ground or floor under the detector unit being serviced. However, existing detector removal tools are designed to fit only specific detector units, typically the particular manufacturer's detectors. The exterior housings of the many detectors in use vary considerably in size and shape. Some are relatively flat, circular housings of various diameters, while others are tapered or frusto-conical in shape and may be greater in height than in width or diameter. Maintenance crews encounter a variety of such smoke and heat detector units in the course of their work, and for this reason are forced to either maintain and carry an assortment of detector removal tools on hand or else use ladders and the like to climb up and reach the detector units.

What is needed is a universal detector removal tool which can replace the different removal tools supplied by the detector manufacturers.

SUMMARY OF THE INVENTION

The invention disclosed here addresses the aforementioned need by providing a universal detector removal tool with a tool head adjustable for gripping different sized and shaped detector head housings and equipped with a long handle for extending the reach of a user standing on a floor under the detector unit.

More particularly, this invention concerns a tool for removing overhead mounted electronic detectors such as smoke and heat detectors having a detector head including a detector housing supported to a detector base and disengageable therefrom by relative rotation of the detector head. The novel tool includes a tool head, a handle attached to the tool head for elevating the tool head into proximity to a detector head to be removed, and a number of grip elements arranged on the tool head for capturing the detector housing in frictional engagement when the tool head is urged against the detector housing, such that the detector head may be rotated relative to the detector base by turning the handle thereby to disengage or reengage the detector body and the detector base. The grip elements are reconfigurable on the tool head into any one of multiple grip patterns, each grip pattern being adapted to capture a differently shaped or sized detector housing. For convenience, the handle of the tool may be a telescoping handle adjustable between a maximum and a minimum handle length, and the handle may be detachable from the tool head.

In one form of the invention the grip elements are removably set in sockets defined in the tool head, and the grip elements may be rearranged among the sockets in any of multiple patterns selected for capturing differently shaped and sized detector housings, such that the tool is adaptable for removing detector heads of different models of electronic detectors. Each of the grip elements may be generally shaped as a cylindrical pin, and each of the grip elements preferably has a relatively high friction surface oriented for making frictional engagement with the detector housing.

It is preferred that the grip elements be arranged and configured to define a detector housing capture perimeter of diminishing size with increasing proximity to the tool head. In particular the grip elements may each have a housing contact surface, the contact surfaces of the grip elements defining therebetween a detector housing capture perimeter, the contact surfaces being mutually divergent such that the capture perimeter is of diminishing size with increasing proximity to the tool head thereby to better conform to tapering exterior surfaces of detector housings.

It is presently preferred to provide the detector removal tool with two concentric arrays of six sockets each, these arrays also being centered on a tool axis which also contains the longitudinal axis of the tool handle. The sockets may be spaced along a circle to define the six corners of an imaginary hexagon for a total of twelve sockets arranged at the corners of two generally concentric hexagons. The number and arrangement of the sockets on the tool head may vary, however.

In one particular form of the invention the grip elements are manually insertable into and manually removable from the sockets, and the grip elements are retained by a press fit in the sockets. The sockets may be blind bores angled relative to the tool handle such that the grip elements inserted therein are mutually divergent and together define an open basket-like structure with a wider open end and narrower base. The grip elements consequently present splayed or divergent grip surfaces towards the detector head being removed.

These and other features and improvements of this invention will be better understood from the following detailed description taken in conjunction with the accompanying drawings.

BRIEF DESCRIPTION OF THE DRAWINGS

FIG. 1 is a perspective view of the detector removal tool of this invention shown with one grip element in exploded relationship to the tool head;

FIG. 2 is a side elevational view of the tool head taken partly in section to illustrate how the grip element is seated in a socket in the tool head;

FIG. 3 is a top plan view of the tool head showing the two concentric rings of six sockets each;

Detailed DESCRIPTION OF THE PREFERRED EMBODIMENTS

Figure 3A:
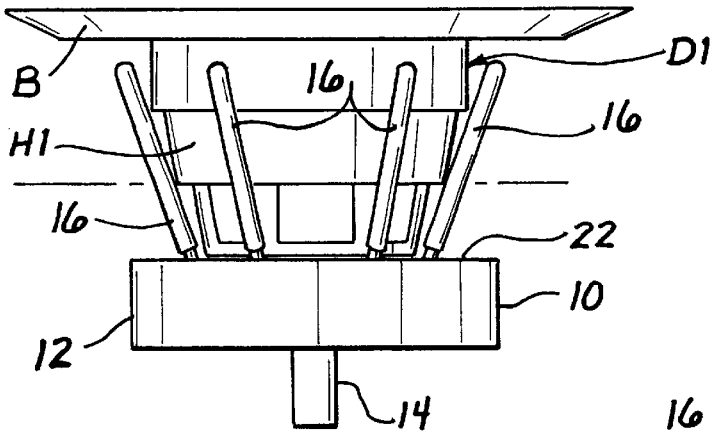
FIG. 3A is a side elevational view showing a relatively deep first type of detector housing gripped by the tool head.

With reference to the drawings, wherein like elements are designated by like numerals, FIG. 1 illustrates the detector removal tool 10 for removing overhead mounted electronic detectors such as smoke and heat detectors. The tool 10 has a tool head 12 and a handle 14 attached to tool head 12 for elevating the tool head into proximity to a detector head to be removed. A number of grip elements 16 are arranged on tool head 12 in a grip pattern for capturing a detector housing in frictional engagement when the tool head is urged against the detector housing and the detector head is rotated relative to the detector base by turning the tool handle thereby to disengage or reengage the detector body and the detector base, in a manner which will be explained below in connection with FIGS. 3A through 6B.

The grip elements 16 are reconfigurable on tool head 12 into any one of multiple grip patterns, some of which are shown in FIGS. 3B, 4B, 5B and 6B, each grip pattern being adapted to capture a differently shaped or sized detector housing such as shown in FIGS. 3A, 4A, 5A and 6A.

As shown in cross sectional detail in FIG. 2. the grip element 16 is set in a corresponding one of multiple sockets 18 defined in the tool head 12. The grip elements are sized to make a slip or press fit in the sockets 18 when inserted by hand and to be manually removable from the sockets. FIG. 3 shows the array of sockets 18 arranged at the corners of two imaginary regular hexagons concentric with the center of the circular tool head, this also being concentric with the axis of the tool handle 14. The grip elements 16 may be rearranged among the sockets 18 in any of multiple grip patterns selected for capturing differently shaped and sized detector housings, making the 10 tool adaptable for removing detector heads of different models of electronic detectors.

Each grip element 16 is generally shaped as a cylindrical pin, with a relatively high friction contact surface 20 at least portions of which are oriented for making frictional engagement with the detector housing. In the illustrated embodiment the high friction surface includes the entire cylindrical surface of the grip element exterior to the mounting socket 18. The high friction surface may, for example, consist of snuggly fitting rubber tubing pressed onto each grip element.

The tool head is shaped as a circular disk and the tool handle 14 is an elongated shaft with its longitudinal axis in axial alignment to the center axis of this disk. The axis of the tool handle and the center axis of the tool head lie along a tool axis about which the tool 10 is rotated by the user when the tool head 12 is engaged to a detector head, as will be explained. The tool handle 14 is preferably an adjustable length handle. For convenient storage, the end of handle section 14*b* is fitted onto a short stub 25 or a bracket affixed to the handle.

The tool head has a circular top surface 22 in which are formed the mounting sockets 18. The mounting sockets 18 are blind bores formed at an angle to the tool axis, and are also at an angle to each other such that the bores diverge from each other and also from the tool axis. In the illustrated embodiment each of the sockets 18 is about one inch deep and formed at an angle of approximately 28 degrees to the tool axis within a radial plane which contains both the tool axis and the longitudinal axis of the particular socket bore. The grip elements 16 splay radially outwardly and jointly define a detector housing capture perimeter, which, by virtue of the mutual divergence of the grip elements and of the contact surfaces 20, is of diminishing size with increasing proximity to the top surface 22 of tool head 12, thereby defining an open cage-like structure of downwardly tapering aperture to better conform to tapering exterior surfaces of detector housings. Each grip element or pin 16 is at least two inches in total length and preferably somewhat longer, leaving at least one inch of pin length exposed above the tool head surface 22 when the pin is inserted into the one inch deep socket bore. The presently preferred exposed length of the grip element or pin 16 is 1.5 to 2 inches. A longer pin length provides a greater range of diameters which can be accommodated between the divergent pins and can engage a greater assortment of different grip features on the detector head some of which may be more desirably arranged for easier removal of the detector head.

The housings of existing removable detector heads in the field range between about two inches and four inches in diameter. In order to accommodate this range of detector sizes, the sockets 18 are disposed along two concentric circles of 2⅝ths inch and 4⅛$^{th}$ inch in diameter respectively. Both circles are centered on the tool head center C and each circle includes six evenly spaced sockets 18, six inner sockets and six outer sockets, as shown in FIG. 3, for a total of twelve sockets 18 on tool head 12. The grip elements 16 along each circle in effect are located at the corners of a regular hexagon, so that the twelve sockets 18 are disposed at the corners of two regular hexagons concentric with the tool axis C.

The number of grip elements 16 is smaller than the number of sockets 18. For example, six grip elements arranged in different patterns among the twelve sockets 18 have been found sufficient and adequate for gripping and removing a wide range of detector head sizes and geometries found in existing detector installations. The shape of the capture perimeter of the tool 10 is variable between different grip patterns, each chosen to capture and grip a particular detector housing size and shape, by selectively distributing and rearranging the six grip elements 16 among the twelve sockets 18.

FIGS. 3A–3B through 6A–6B illustrate how the grip elements 16 are rearranged and configured into different grip patterns in order to capture and engage different detector heads.

Figure 3B:
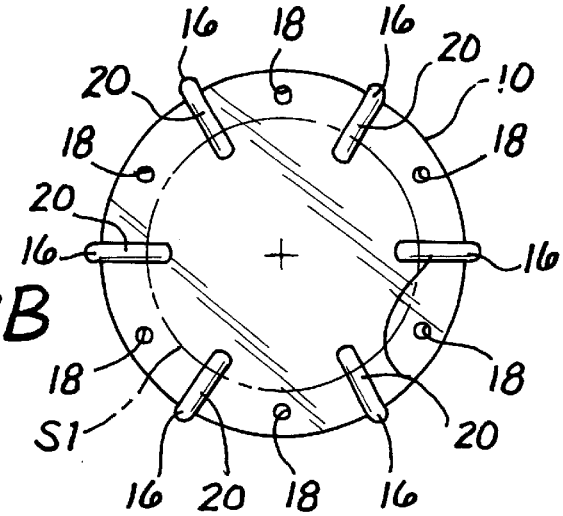
FIG. 3B is a top plan view of the tool head showing a first pattern of grip elements suited for gripping the detector housing of FIG. 3A.

FIG. 3A shows the tool head 12 engaging a relatively deep detector head D1. FIG. 3B shows the grip pattern used for this purpose, with the six grip elements 16 fitted in the six inner sockets 18 on the tool head 12. The tapering shape of the detector head nestles into the tapering array of grip elements 16 and engages the lower, more closely grouped portions of the divergent grip elements 16 as suggested by the phantom lined circle S1. The tool head is pressed upwardly by means of the handle 14 until the side surfaces of the grip elements firmly press against the exterior side surface of the detector head Dl by the user standing on the ground or floor underneath the detector unit. The user turns the handle 14 about its longitudinal axis while maintaining upward pressure of the tool head against the detector head D1, thereby transmitting the torque of the turning handle to the detector head through frictional engagement of the grip elements with the housing H1 of the detector head. The turning force applied by the tool 10 operates to turn or twist the detector head relative to the detector base B. thereby disengaging and releasing the detector head from the base. The free detector head is supported between the grip elements 16 on the tool head, and can then be lowered with the tool 10 and retrieved by the user once within arm's reach.

Figure 4A:
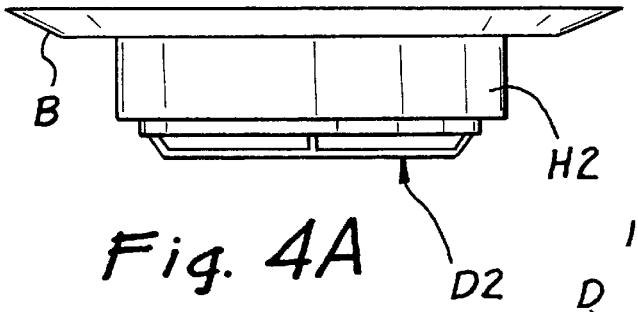
FIG. 4A is a side elevational view showing a relatively flat second type of detector housing gripped by the tool head.
Figure 4B:
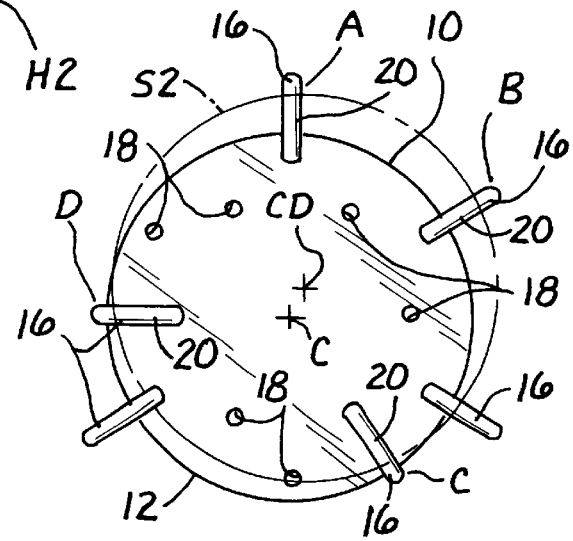
FIG. 4B is a top plan view of the tool head showing a second pattern of grip elements suited for gripping the detector housing of FIG. 4A.

FIG. 4B shows a second grip pattern in which only four grip elements 16 designated by letters a through d are operative for engaging a flatter but somewhat wider detector head D2 of FIG. 4A. Three grip elements a,b,c are fitted in corresponding outer sockets 18 while the fourth grip element d is fitted in an inner socket, to define an asymmetrical grip pattern. In this case the more widely spread apart upper portions of the divergent grip elements a–d capture the side surface of the detector head housing H2, as suggested by the phantom lined circle S2 in FIG. 4B. The remaining two grip elements 16 are fitted out of the way in convenient sockets or may be removed from the tool head 12. It will be appreciated that the detector housing H2 is gripped eccentrically to the center C of tool head 12, as indicated by detector housing CD. Application and use of the removal tool 10 for disengaging and lowering the detector head D2 is otherwise as described in the preceding paragraph.

Figure 5A:
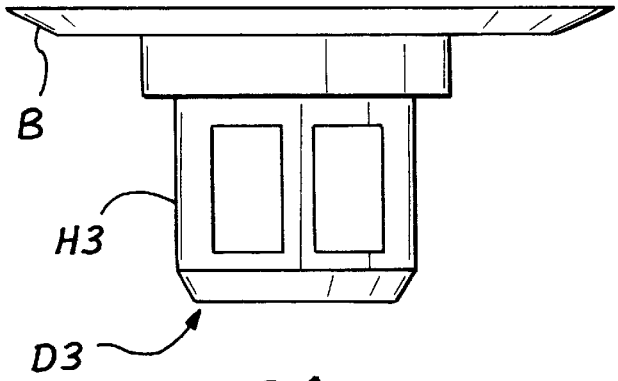
FIG. 5A is a side elevational view showing a relatively tall and narrow third type of detector housing gripped by the tool head.
Figure 5B:
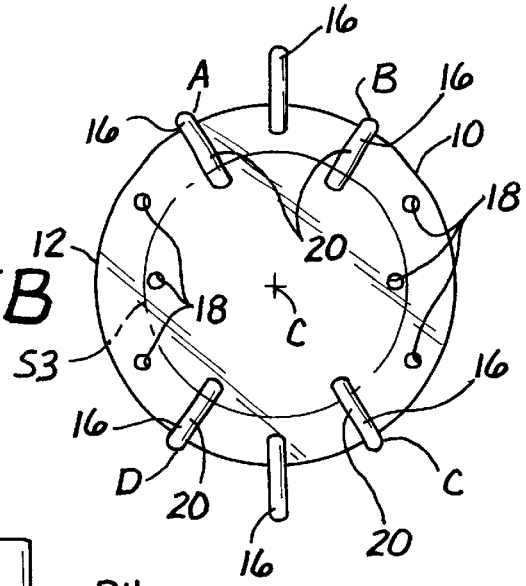
FIG. 5B is a top plan view of the tool head showing a third pattern of grip elements suited for gripping the detector housing of FIG. 5A.

FIG. 5A shows a long and narrow detector head D3 which is captured in a grip pattern as depicted in FIG. 5B defined by four grip elements 16 designated by letters a–d. The contact surfaces 20 of these four grip elements are engaged by the housing H3 as suggested by the phantom lined circle S3. In this case the four grip elements 16 a–d are arranged in a rectangular pattern in four of the inner sockets 18, and the remaining two grip elements 16 are positioned out of the way in two outer sockets 18.

Figure 6A:
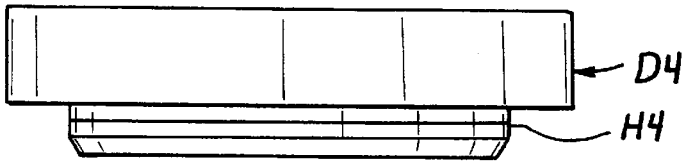
FIG. 6A is a side elevational view showing a relatively flat and wide fourth type of detector housing gripped by the tool head.
Figure 6B:
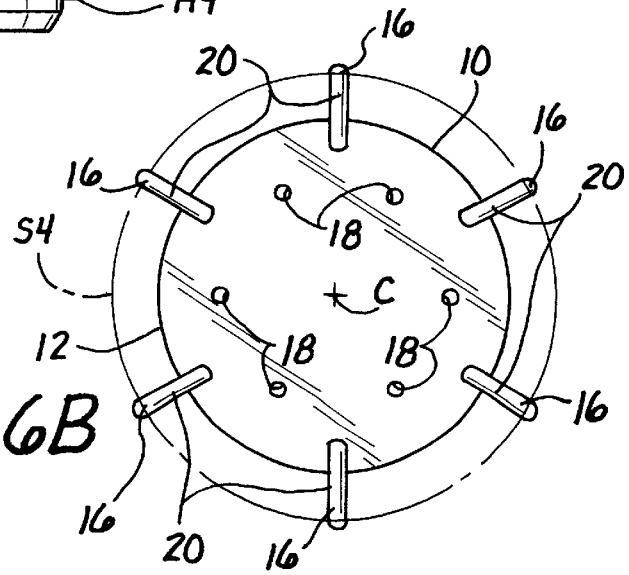
FIG. 6B is a top plan view of the tool head showing a fourth pattern of grip elements suited for gripping the detector housing of FIG. 6A.

FIG. 6A shows a particularly flat and wide detector head D4 with a wide detector housing H4 which covers and conceals the mounting base of the detector unit. In this case the grip elements are deployed and configured in the grip pattern illustrated in FIG. 6B where all six grip elements 16 are fitted in corresponding ones of the six outer sockets 18. The wide detector housing H4 engages against the more widely spaced, upper portions of the divergent grip elements 16, as suggested by the phantom lined circle S4.

Except for the rearrangement of the grip elements 16 into different grip patterns as needed to make good engagement with the different detector heads, use of the tool 10 is the same in each case depicted in FIGS. 3A,3B through 6A,6B.

Figure 7:
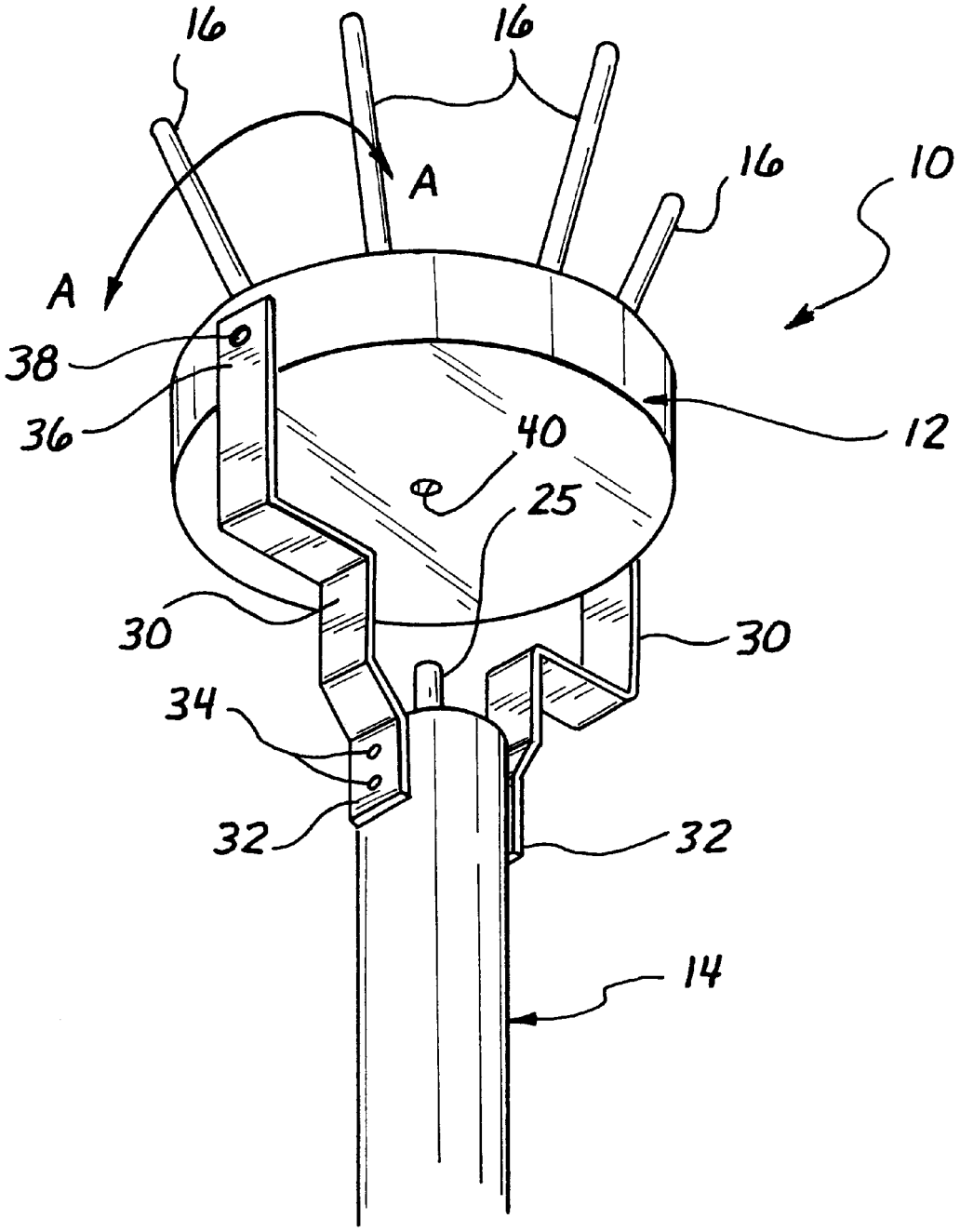
FIG. 7 shows an alternate, pivotal attachment of the tool head to the tool handle.

FIG. 7 shows an alternate form of attaching the tool handle 14 to the tool head 10 by means of a pair of brackets 30. Each bracket 30 has a lower end 32 fastened to the upper end of the tool handle 14 by fasteners 34. The tool head 10 is pivotably connected between the upper ends 36 of the two brackets 30 on pivots 38 which may be nails or equivalent fasteners selected to provide suitable shafts extending into diametrically opposed bores (not shown in the figure) in the tool head 10, so as to allow the tool head to pivot about a diametrically extending pivot axis through an arc suggested by arrow A—A. Such pivotal movement of the tool head 10 facilitates in some cases engagement between the tool head and the detector unit being serviced. The pivotal attachment of the tool head gives the operator wider latitude in his or her placement and stance under the detector unit because the tool handle may be displaced sideways away from the vertical while maintaining engagement between the tool head and the detector unit during the detector removal operation. The upper end of the tool handle may include a stub 25 sized to mate into a corresponding hole 40 in the underside of the tool head 10, allowing the tool head to be secured in fixed position to the tool handle 14, if desired, after removing the two brackets 30 from the tool handle.

It will also be appreciated from the foregoing that a given arrangement of the grip elements into a particular grip pattern is able to capture and engage a range of detector head shapes and sizes because of the divergence of the grip elements, whereby a wider detector housing may be engaged by the more widely spaced upper portions of the splayed grip elements 16 while a narrower detector housing may nestle deeper among the splayed grip elements and engage against lower, more closely spaced portions thereof. Grip patterns or pin setups suitable for particular detector units or for known detector diameters may be provided on a chart for the convenience of the user, or may be determined by trial and error with detectors encountered in the field.

It should be understood that the shape of the tool head may be changed from the disk shape shown in the drawings, the grip elements can take shapes other than the cylindrical pin shapes shown, and the number and arrangement of the sockets 18 on the tool head may be altered, all provided that a variety of grip patterns are possible such as to positively engage a range of detector head sizes and shapes. While particular dimensions or ranges have been specified above, these may be altered to a considerable extent without adversely impacting the usefulness and effectiveness of the removal tool.

While particular embodiments of the invention have been shown and illustrated for purposes of clarity and example, many changes, substitutions and modifications to the described embodiments will be apparent to those having only ordinary skill in the art without thereby departing from the scope of this invention as defined by the following claims.

What is claimed as new is:

1. A tool for removing overhead mounted electronic detectors such as smoke and heat detectors having a detector head including a detector housing supported to a detector base and disengageable therefrom by relative rotation of the detector head, comprising:

a tool head;

a handle attached to said tool head for elevating the tool head into proximity to a detector head to be removed; and a plurality of grip elements arranged on said tool head for capturing said detector housing in frictional engagement when said tool head is urged against the detector housing such that the detector head may be rotated relative to the detector base by turning said handle thereby to disengage or reengage the detector head and the detector base;

said grip elements each including a relatively high friction contact surface to engage the said detector housing and in combination define a detector housing capture perimeter between said grip elements of diminishing size with increasing proximity to the tool head for capturing the detector housing between said contact surface of some or all of said grip elements by pressing the grip elements against the exterior of the detector housing;

said grip elements being reconfigurable on said tool head into any one of multiple grip patterns, each grip pattern being adapted to capture a differently shaped or sized detector housing.

2. The tool of claim 1 wherein said grip elements are removably set in sockets defined in said tool head, and said grip elements may be rearranged among said sockets in any of multiple patterns selected for capturing differently shaped and sized detector housings, whereby said tool is adaptable for removing detector heads of different models of electronic detectors.

3. The tool of claim 1 wherein each of said grip elements is generally shaped as a cylindrical pin, the pins being mutually divergent on the tool head for defining said capture perimeter of diminishing size.

4. The tool of claim 3 wherein each of said grip elements is wrapped with material providing said relatively high friction surface for making said frictional engagement with the detector housing.

5. The tool of claim 1 wherein said handle is a telescoping handle adjustable between a maximum and a minimum handle length.

6. The tool of claim 1 wherein said handle is detachable from said tool head.

7. The tool of claim 1 wherein said grip elements comprise six grip elements.

8. The tool of claim 1 wherein said grip elements are located at the corners of a regular or irregular polygon.

9. The tool of claim 2 wherein said sockets are disposed at the corners of one or more regular hexagons concentric with an axis of said handle.

10. A tool for removing overhead mounted electronic detectors such as smoke and heat detectors having a detector head including a detector housing supported to a detector base and disengageable therefrom by relative rotation of the detector head, comprising:

a tool head;

a handle attached to said tool head for elevating the tool head into proximity to a detector head to be removed a larger plurality of sockets in said tool head;

a lesser plurality of grip elements each in the shape of a straight pin, said grip elements being reconfigurable among said sockets into different grip patterns, said sockets being angled relative to each other and divergent from a tool head axis such that said straight pin grip elements are divergent from the said center axis when inserted in said sockets, each grip pattern being selected for capturing a differently sized or shaped detector housing in frictional engagement between said grip elements by contact of the grip elements with an exterior of the detector housing when said tool head is urged against the detector housing, such that the detector head may be rotated relative to the detector base by turning said handle thereby to disengage or reengage the detector head and the detector base.

11. The tool of claim 10 wherein said grip elements are manually insertable into and removeable from said sockets.

12. The tool of claim 11 wherein said grip elements are retained by slip fitting into said sockets.

13. The tool of claim 11 wherein said sockets comprise twelve sockets arranged at the corners of two generally concentric hexagons.

14. A method for removing an overhead mounted electronic detector such as a smoke or heat detector by an operator standing below the detector, said detector having a detector head including a detector housing supported to a detector base and disengageable therefrom by relative rotation of the detector head, comprising the steps of:

providing a detector removal tool having a tool head, a handle attached to said tool head for elevating the tool head into proximity to a detector head to be removed, and a plurality of grip elements on the tool head having mutually divergent grip surfaces;

capturing the detector housing between the divergent grip surfaces of the grip elements in a frictional grip by urging the tool head against the detector housing; and turning the tool handle while maintaining said frictional grip thereby to turn the detector housing relative to the detector base for disengaging the detector housing from the detector base; and rearranging said grip elements on said tool head for defining different grip patterns selected for capturing differently sized or shaped detector housings in frictional engagement when said tool head is urged against the detector housing, such that the detector head may be rotated relative to the detector base by turning said handle thereby to disengage or reengage the detector head and the detector base.

15. The tool of claim 14 wherein said rearranging of the grip elements is by manually inserting and removing the grip elements in and out of sockets defined in the tool head.

* * * * *